United States Patent [19]

Lo et al.

[11] 4,049,158

[45] Sept. 20, 1977

[54] PRESSURIZED CONTAINER-DISPENSERS AND FILLING METHOD

[75] Inventors: Vincent Lo; Kenneth D. Vos; Germane M. Suchla, all of Racine, Wis.

[73] Assignee: S. C. Johnson & Son, Inc., Racine, Wis.

[21] Appl. No.: 631,772

[22] Filed: Nov. 13, 1975

[51] Int. Cl.[2] ..... B65D 35/28; B65D 83/14

[52] U.S. Cl. ..... 222/95; 222/399

[58] Field of Search ..... 169/11, 30, 31; 222/399, 95, 386.5, 3; 229/95, 386.5, 399

[56] References Cited

U.S. PATENT DOCUMENTS

| | | | |
|---|---|---|---|
| 1,608,155 | 11/1926 | Barnebey | 222/3 |
| 3,122,284 | 2/1964 | Miles | 222/399 |
| 3,659,395 | 7/1972 | Movane et al. | 222/386.5 |
| 3,858,764 | 1/1975 | Watson | 222/399 |

*Primary Examiner*—Stanley H. Tollberg
*Assistant Examiner*—Hadd S. Lane

[57] ABSTRACT

A pressurized container-dispenser characterized by a separate pressure source chamber containing a gas-adsorbent solid and an adsorbable gas and having means to transmit source chamber pressure to a product chamber for dispensing of a product therefrom. Preferred transmission means include a moveable wall separating the product and source chambers, a check valve, a constant pressure valve, and a membrane of the type allowing passage of gas but resisting passage of non-gaseous fluid. In a preferred embodiment the source chamber is defined by an enclosure of substantially fixed volume secured adjacent the product chamber. In another, the source chamber is defined by an unsupported enclosure free within the product chamber.

37 Claims, 18 Drawing Figures

PRESSURIZED CONTAINER-DISPENSERS AND FILLING METHOD

A method of filling and pressurizing container-dispensers characterized by loading a gas-adsorbent solid and an adsorbable gas into a chamber separate from a chamber containing the product to be dispensed. In a preferred embodiment the solid is loaded prior to charging of the product through a first orifice, and thereafter the source chamber is charged with gas through a second orifice. In other preferred embodiments the source chamber is filled in whole or in part while remote from the product chamber and thereafter inserted into the product chamber.

BACKGROUND OF THE INVENTION

This invention relates to the field of pressurized container-dispensers.

Pressurized container-dispensers, often referred to as "aerosols", are very popular and are used in great numbers because of several important advantages including: (1) the convenience they provide in dispensing a wide variety of products; (2) their ability to deliver desired product concentrations; (3) their ability to deliver product in the optimum form for effectiveness in use; (4 their ability to deliver product at a desired rate; (5) their resistance to contamination by virtue of their hermetic seals; and (6) their improved safety, in comparison with many other packaging forms, from harmful misuse by children. Such devices are available in a wide variety of forms. Numerous systems, packages and propellents, and numerous filling and pressurizing methods have been developed. Much effort has been expended on improvement and innovation in this field.

By far the most popular type of pressurized container-dispenser utilizes a condensible gas as propellent. As used herein, the term "condensible gas" refers to a material which is in the liquid phase at the elevated pressures in the container (typically about 15 to 150 psig) throughout the range of temperatures encountered (typically about 30° to 130° F), but which has a low boiling point at atmospheric pressure. The liquid propellent is charged into the container where it commingles with the product to be dispensed. When the container is sealed, a portion of the propellent evaporates into the headspace (i.e., the space within the container above the fluid product, building pressure in the container until the steady state is reached. As the contents including the propellent are dispensed, the remaining liquid propellent quickly vaporizes to maintain container pressure substantially constant.

Condensible gases have several well-recognized disadvantages as propellents. With some products, the commingling of product and propellent poses a problem in product use. More importantly, there are problems or potential problems inherent in the condensible gases themselves. For example, the popular fluorocarbon propellents have been subject to recent criticism because of a new theory which states that fluorocarbon gases from aerosol containers have an destructive effect on the ozone layer of the atmosphere, which in turn causes an increase in the level of harmful solar radiation reaching the surface of the earth. This potential problem has led the assignee of this application to discontinue further use of fluorocarbon propellents until such time as this theory may be shown to be incorrect. Another group of condensible gas propellents, the hydrocarbon propellents, are flammable under certain conditions. Although such propellents are completely safe when properly used, severe misuse can cause accidents.

Another group of gaseous propellents, the group to which this invention most directly applies, are the "non-condensible" gases, that is, gases which are generally non-condensible in the temperature and pressure ranges typically used or encountered in pressurized packages. Carbon dioxide, nitrous oxide, nitrogen and the inert gases are examples. Since these gases do not undergo a phase change when used in pressurized packages, they are subject to Boyle's law; that is, for a given amount of gas at a constant temperature their pressures are inversely proportional to the volumes in which they are contained. Actually, since such propellent gases are soluble to some extent in the liquid products (i.e., the "intermediates") with which they are used, Boyle's law may not be rigorously applied. However, with most intermediates and with typical initial gas volumes, an acceptably high initial pressure may drop to unacceptably low levels as the product is dispensed and the headspace volume increases. In any case, the pressure drop is severe and makes achievement of uniform dispensing characteristics difficult or impossible with most products, particularly those which do not have a high solvency for the propellent gas.

OBJECTS OF THE INVENTION

An object of this invention is to provide pressurized container-dispensers having propellent systems overcoming the aforementioned problems.

Another object of this invention is to provide a method of filling and pressurizing container-dispensers which overcomes the aforementioned problems.

A further object of this invention is to provide pressurized container-dispensers utilizing non-condensible gases as propellents but displaying reinforced dispensing pressure which is sufficiently stable for complete dispensing of fluid products.

Other objects will be apparent from the description of preferred embodiments of the device and method of this invention.

BRIEF DESCRIPTION OF THE INVENTION

This invention utilizes the concept of adsorptivity of gas on certain solid materials to provide a gas reserve in a pressurized package. Adsorption is the adhesion of gas molecules to the surfaces of solids by virtue of intermolecular forces between the gas and the surface of the solid material. All solid materials have a degree of adsorptivity which is dependent upon their molecular and physical structure. Certain materials have sufficient adsorptivity (e.g., about 5% or more by weight of solid at 100 psig and 70° F) to be useful as storage means for adsorbable propellent gases in pressurized container-dispensers. In such materials, the adsorbed gas may be characterized as a "pseudo-liquid" because of the high concentration of gas molecules on the adsorptive material. Solid materials having a sufficient adsorptivity as described are referred to herein as "gas-adsorbent solids" and the gases adsorbed to sufficient degree thereon are referred to as "adsorbable gases".

Suitable gas-adsorbent solids for use in this invention include ethylvinylbenzene-divinylbenzene polymer known by the trademark POROPAK Q and available from Waters Associates, Milford, Massachusetts, crystalline calcium alumino silicate molecular sieve materials such as molecular sieves 4A, 5A and 13X available from Linde Sieves Division, Union Carbide; a diatomaceous earth known by the trademark DIATOMITE and available from Johns-Manville Company, New York, New York; and activated charcoal. Activated charcoal is highly preferred because of its high degree of adsorptivity. Certain forms of activated charcoal have surface areas as high as 1500 to 2500 square meters per gram, which provides high adsorption potential. Such materials have an adsorptivity for carbon dioxide on the order of 63% by weight at 100 psig and 70° F., 5/6 of which is readily released during a pressure reduction to atmospheric pressure, and an adsorptivity for nitrous oxide of up to 75% by weight, 5/7 of which is readily released during such pressure reduction.

Suitable adsorbable gases, of course, depend to some extent on the solid material to be used. Carbon dioxide, nitrous oxide, nitrogen, helium, argon, neon, krypton, xenon and mixtures thereof, all non-condensible gases, are believed to be acceptable for use in this invention. Condensible gases will be adsorbed and could be used in this invention; however, certain primary advantages would not be available unless non-condensible gases are used. Suitable gases will be known to those skilled in the art who are made aware of this invention. Carbon dioxide and nitrous oxide have been found to be particularly advantageous in this invention because of their high level of adsorption compared with certain other acceptable gases.

Physical adsorption is generally readily reversible process, which is pressure dependent. An increase in pressure increases the degree of adsorption. On a subsequent decrease in pressure the adsorbed gas is desorbed along the same isotherm curve.

As will be described in detail hereinafter, a gas-adsorbent solid and an adsorbable gas are placed into a separate pressure source chamber in a container-dispenser. The pressure in such chamber is transmitted to a chamber containing the product to be dispensed. When the pressure in the pressure source chamber is reduced, as will be described, adsorbed gas is freed from adsorption on the surface of the solid. Thus, such gas-adsorbent solid materials can provide a gas reserve whereby pressure in a pressurized package can be substantially reinforced. "Substantially reinforced", as used herein, means that the reduction in pressure caused by a decrease in the amount of gas per unit volume is much less than would occur without the presence of a gas-adsorbent solid material.

This invention includes a number of unique systems for utilization of the adsorption phenomenon. In each case, a pressure source chamber separate from a product chamber is incorporated in the container-dispenser. Various means are used to transmit the source chamber pressure to the product chamber for dispensing a product therefrom. In some embodiments, the transmission means includes a moveable wall which separates the product and source chambers. In one embodiment, a collapsible bag may be used to form the product chamber, the source chamber being formed by the remaining portion of the container interior. In another embodiment, an expandable bag forms the pressure source chamber and exerts force on the product in the product chamber. In yet another embodiment, a piston member which is in sealed, slidable engagement with the walls of a container body forms the means for transmission of the substantially reinforced source chamber pressure to the product chamber. In such cases, the propellent gas is typically isolated from the product at all times during product use.

In some cases it is desirable to commingle propellent gas in the product to be dispensed. To accomplish this, the means to transmit pressure from the source chamber to the product chamber is a gas transmission means. In such embodiments, the source chamber will usually have a constant volume and will emit propellent gas to the product chamber as needed to replenish the pressure in the product chamber. In one embodiment, a check valve is used. When the pressure in the product chamber is reduced by product dispensing, propellent gas from the pressure source chamber is transmitted through the check valve to restore the pressure in the product chamber. In another embodiment, a constant pressure valve is used to maintain pressure in the product chamber at a substantially constant level no higher than the pressure in the source chamber. In another embodiment, a membrane of the type permitting passage of gas but resisting passage of non-gaseous fluid is used as the means to transmit pressure from the pressure source chamber to the product chamber.

The pressure source chamber of substantially fixed volume may be defined by an enclosure secured to the container body or may be defined by an unsupported enclosure free within the product chamber.

In each embodiment of the device of this invention, the pressure in the source chamber is substantially reinforced by the availability of adsorbed gas when the pressure in the product chamber drops and causes a decrease in gas/volume in the source chamber.

This invention also provides a method of filling and pressurizing container-dispensers characterized by loading a gas adsorbent solid and an adsorbable gas into a chamber which is separate from a chamber containing the product to be dispensed. In a preferred embodiment of the inventive method, the solid is loaded prior to charging of the product through a first orifice and thereafter the source chamber is charged with gas through a second orifice. In other preferred embodiments the source chamber is filled, in whole or in part, while remote from the product chamber and thereafter inserted into the product chamber.

DETAILED DESCRIPTION OF PREFERRED EMBODIMENTS

Throughout the drawings like numerals will be used to designate like parts.

Figure 1:
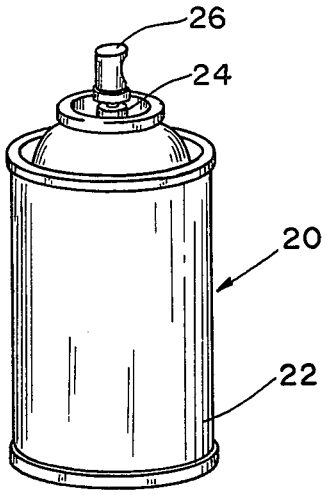
FIG. 1 is a perspective view of a pressurized container-dispenser according to this invention.

FIG. 1 illustrates a pressurized container-dispenser 20 according to this invention having a container body 22, within which a chamber containing a fluid product to be dispensed, and a valve means 24 for controlling product dispensing. Valve means 24 includes a dispensing button 26 mounted on a valve stem 27, as well known to those skilled in the art. Within container-dispenser 20 is a means to pressurize the product chamber whereby to expel product through valve means 24 and dispensing button 26.

The remaining figures illustrate internal details of preferred embodiments of container-dispensers according to this invention. In each embodiment, there is a product chamber and a separate pressure source chamber within the container body. The pressure source chamber in each case contains a gas-adsorbent solid and a gas adsorbable thereon. The amount of solid and gas to use depends on many factors and may readily be determined, by one skilled in the art and aware of this invention, to fit the particular requirements of product, container size, embodiment utilized, initial volume of the pressure source chamber, solid material used and gas used. By way of example, however, for a 7-ounce container of furniture polish, using (1) the embodiment of FIG. 6, (2) a pressure source chamber having an initial volume of about 70 cubic centimeters, (3) AMOCO activated charcoal in power or pellet form as the gas-adsorbent solid, and (4) carbon dioxide as the adsorbable gas, it has been found that about 20 grams of activated charcoal and 8 grams of carbon dioxide gas are acceptable. Greater or lesser amounts of gas and solid are also operable. Larger or smaller initial volumes for the pressure source chamber are also operable.

Figure 2:
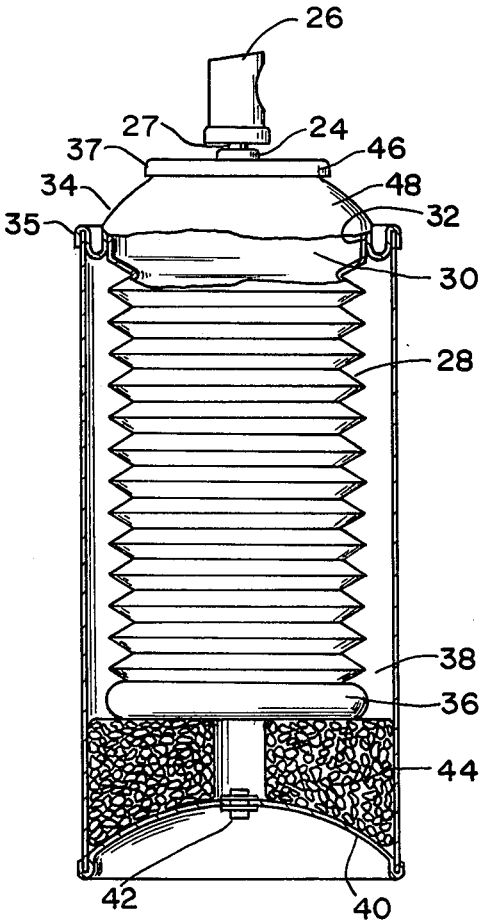
FIGS. 2–7 and 9–13 are side cutaway and sectional views showing various embodiments of the device of this invention.
Figure 4:
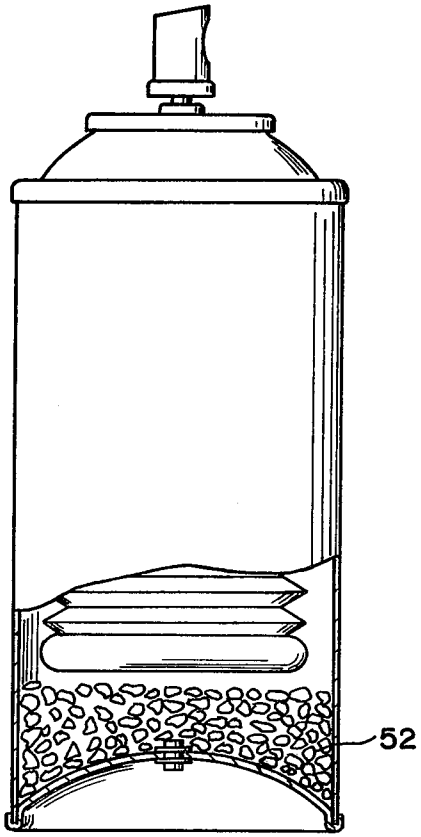
Figure 3:
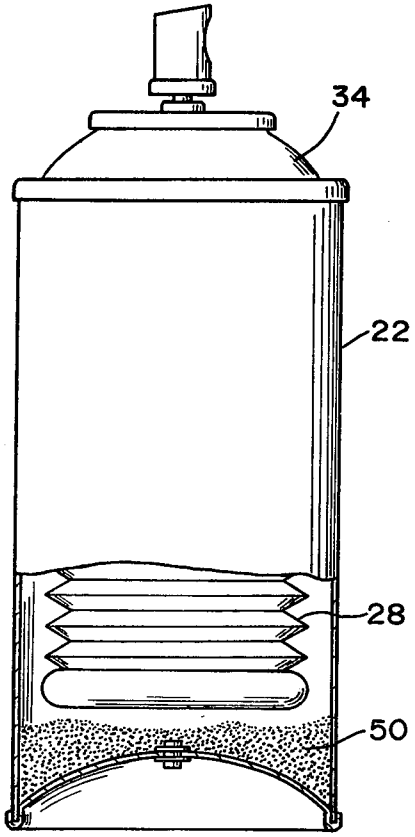
Figure 9:
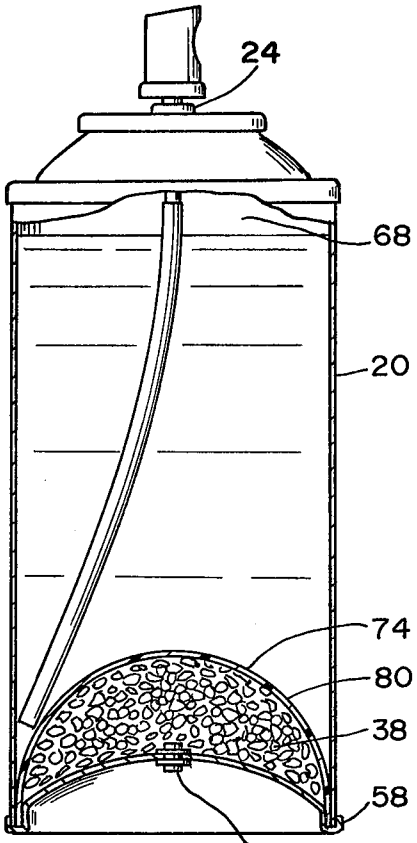

FIGS. 2–4 illustrate embodiments of this invention having a pleated collapsible bag 28 forming a product chamber 30. Bag 28 is secured at its upper, open end 32 about upper edge 34 of container body 22. Bag 28 may be attached to double seam 35 or to valve cup seam 37. Lower end 36 of bag 28 is closed. Bag 28, which contains the product to be dispensed, is made of some barrier material, that is, a material which will not be permeated by either the product within product chamber 30 or any of the propellent materials outside thereof.

The volume within container body 22 includes product chamber 30 and a separate pressure source chamber 38 comprising the volume defined within container body 22 but outside product chamber 30. Most of the volume of pressure chamber 38 is within the container body in that area below lower end 36 of collapsible bag 28. Collapsible bag 28 forms a moveable wall which separates product chamber 30 and pressure source chamber 38.

Container body end 40 has a propellent charging valve 42 mounted therein. Charging valve 42 is similar in form and operation to that described in U.S. Pat. No. 3,572,402, to R. W. Beffel. Propellent is charged into pressure source chamber 38 therethrough and, after charging, valve 42 is self-closing to seal pressure source chamber 38.

In the embodiment of FIG. 2, a donut-shaped piece 44 of activated charcoal is placed within pressure source chamber 38 directly below lower end 36 of collapsible bag 28. After collapsible bag 28 is filled with the product to be dispensed (which may be accomplished through valve means 24 or under the valve cup 46 prior to seaming thereof to dome 48), a gas adsorbable on activated charcoal, such as carbon dioxide or nitrous oxide, is injected into pressure source chamber 38 through charging valve 42. A large amount of the charged adsorbable gas is adsorbed on the surface of charcoal 44 while some remains as a free gas in the limited spaces available in pressure source chamber 38.

When dispensing button 26 is depressed to open valve 24, the pressure in pressure source chamber 38 begins to collapse bag 28 thereby forcing the product contained within bag 28 to be expelled through valve 24 and dispensing button 26. The collapse of bag 28 decreases the volume of product chamber 30 and increases the volume of pressure source chamber 38. As the volume of pressure source chamber 38 increases, there is a tendency for the pressure therein to decrease. However, as this occurs some of the gas which had been adsorbed on the activated charcoal 44 is released from adsorption and reinforces the pressure in pressure source chamber 38. Accordingly, as the volume of pressure source chamber 38 increases, the pressure therein does not drop according to Boyle's law; the drop in pressure is much less precipitous. The pressure in source chamber 38 remains sufficient for complete and satisfactory dispensing of the contents of bag 28.

The container-dispenser of FIG. 2 may be filled and pressurized by the following method. The annular charcoal ring 44 may be placed into container body 22 prior to the attachment of collapsible bag 54 to upper edge 34 of the container body. The fluid product may next be charged into product chamber 30 around valve cup 46 which is thereafter seamed to dome 48. After product charging, the charging of source chamber 38 is completed by injecting adsorbable gas through charging valve 42. During and immediately after charging of gas, the adsorption process occurs. Within a short period of time, a steady state will be reached in which a portion of the gas is adsorbed and the remainder is in the free space within pressure source chamber 38.

In some cases, it may be possible to fill the product chamber after complete charging of the pressure source chamber. However, to do so would require substantial pressure in product filling to overcome the pressure already available in source chamber 38.

The container-dispenser of FIG. 3 is similar in all respects to the embodiment of FIG. 2 except that the activated charcoal used as a gas-adsorbent solid in FIG. 3 is a powder 50. Activated charcoal powder 50 may be injected into pressure source chamber 38 through charging valve 42 prior to or concurrently with the charging of propellent gas. Alternatively, the powder may be placed within the container prior to sealing of bag 28 to the upper edge 34 of container body 22.

The embodiment of FIG. 4 is also similar to that of FIG. 2 except that the gas adsorbable solid is in the form of numerous irregular shaped pellets 52, such as pellets of activated charcoal. Pellets 52 are inserted into the container body prior to sealing of bag 28 to upper edge 34 of container body 22. Pellets 52 are placed into the container prior to product charging and prior to charging of propellent gas. We have found that the physical form of gas-adsorbent solid can vary substantially; pellets, powders and large unitary pieces are examples of acceptable forms. Physical form may be tailored to processing requirements.

Figure 5:
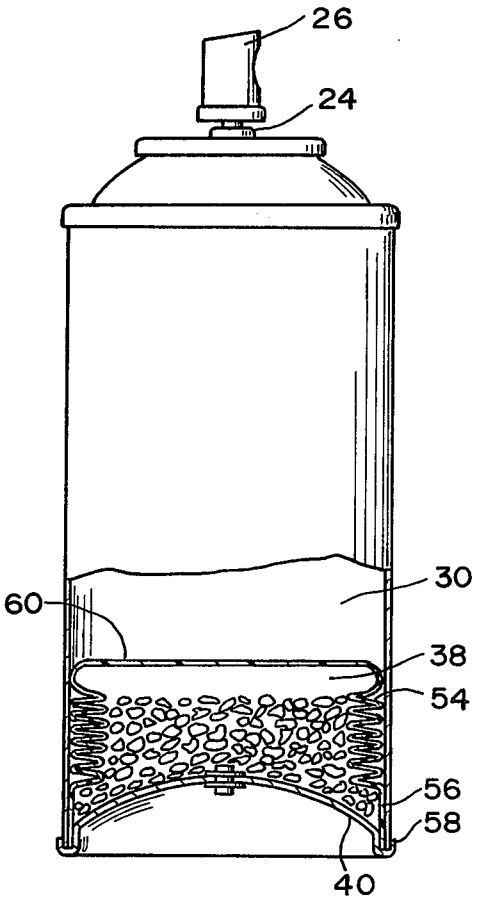

The container-dispenser illustrated in FIG. 5 has a pressure source chamber 38 defined by expandible bag 54 which is sealed at its open end 56 to lower edge 58 of container body 22. Product chamber 30 is the volume within container body 22 which is outside of expandible bag 54. Expandible bag 54 contains pellets of activated charcoal or another gas-adsorbent solid. Such pellets will be placed therein during container construction. A gas adsorbable thereon is injected into pressure source chamber 38 within expandible bag 54 through charging valve 42, preferably after product chamber 30 has been filled with a product to be dispensed. As dispensing button 26 is depressed to open valve means 24, the pressure in product chamber 30 drops whereupon the pressure in pressure source chamber 38 causes expansion of bag 54, the end 60 of which acts as a piston to force product out of product chamber 30. As the volume of pressure source chamber 38 in FIG. 5 increases, there is a tendency for the pressure therein to drop which in turn causes the release of propellent gas from adsorption on the activated charcoal pellets. Such release of gas reinforces the available pressure within pressure source chamber 38.

Figure 6:
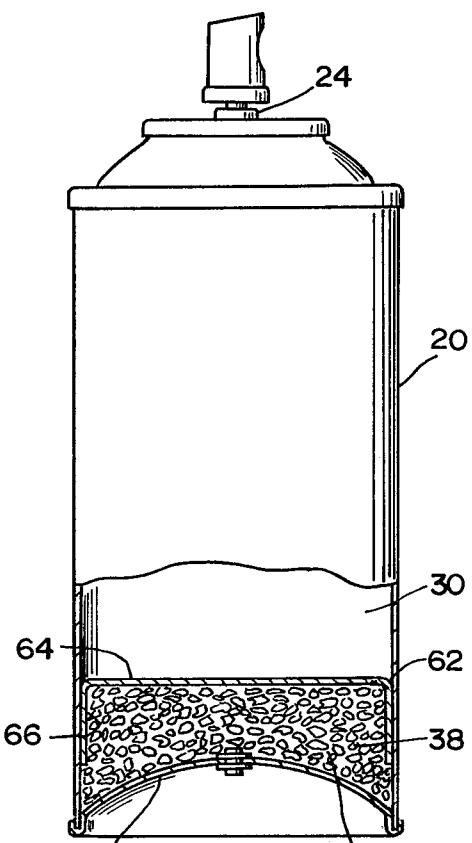

The embodiment illustrated in FIG. 6, like those in FIGS. 2–5, includes a moveable wall separating product chamber 30 and pressure source chamber 38. However, instead of a bag the moveable wall is a cylindrical piston 62 having a circular end 64 and annular cylindrical walls 66 which are in sealed, slidable engagement with the cylindrical walls of container body 20. Irregular shaped activated charcoal pellets 52 are the gas-adsorbent solid within pressure source chamber 38. After charging of product and propellent gas, piston 62 will "find" a position such that pressure in source chamber 38 is substantially in balance with the resistance pressure of product chamber 30. When valve 24 is opened, piston 62 slides away from body end 40 to force product within product chamber 30 out of the container. During this action, gas which had been adsorbed on pellets 52 is released therefrom and serves to reinforce the pressure within pressure source chamber 38.

In each of the specific embodiments illustrated in FIGS. 2–6, as product is dispensed the volume of the pressure source chamber increases while the total amount of propellent gas therein remains constant. In the embodiments illustrated in FIGS. 7–17, the volume of the pressure source chamber remains substantially constant while the amount of propellent gas therein is reduced by passage of some propellent gas from the pressure source chamber to the product chamber to provide the pressure within the product chamber which is necessary for product dispensing. Embodiments in which gas passes from the pressure source chamber to the product chamber are particularly preferable when it is desired for any reason to have propellent gas in a solution with the fluid product.

In each of the embodiments shown in FIGS. 7–17, propellent gas at dispensing pressure is contained in the headspace 68 within product chamber 30. Headspace pressure drives the fluid product 70 up dip tube 72 and out through valve 24 and dispensing button 26. As the headspace volume increases, headspace pressure drops, causing passage of propellent gas from pressure source chamber 38 to product chamber 30 to reinforce the headspace pressure and preserve adequate product dispensing. As propellent gas is passed from pressure source chamber 38 to product chamber 30, additional propellent gas which had been adsorbed on the gas-adsorbable solid within pressure source chamber 38 is released therefrom into the space available in source chamber 38 to reinforce the pressure therein.

Figure 7:
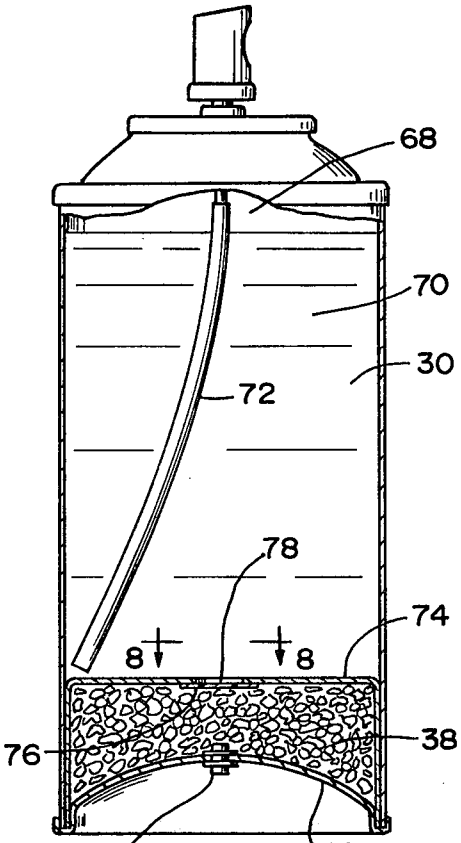
Figure 8:
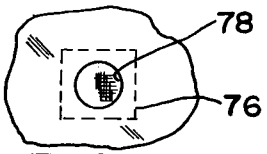
FIG. 8 is a partial sectional view taken along section 8—8 as indicated in FIG. 7.
Figure 10:
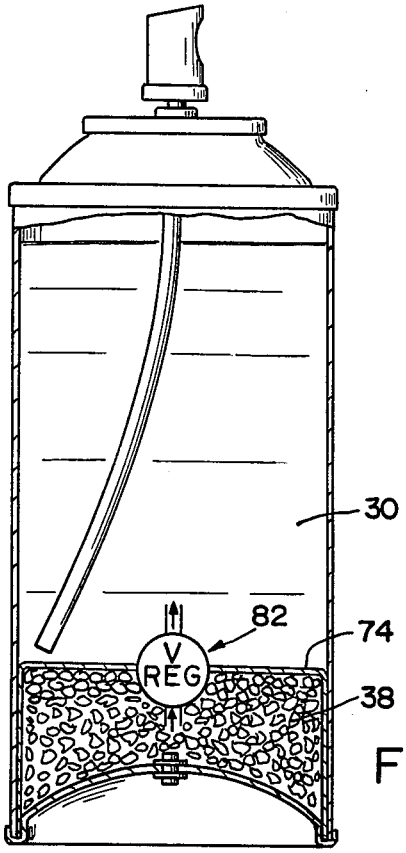
Figure 11:
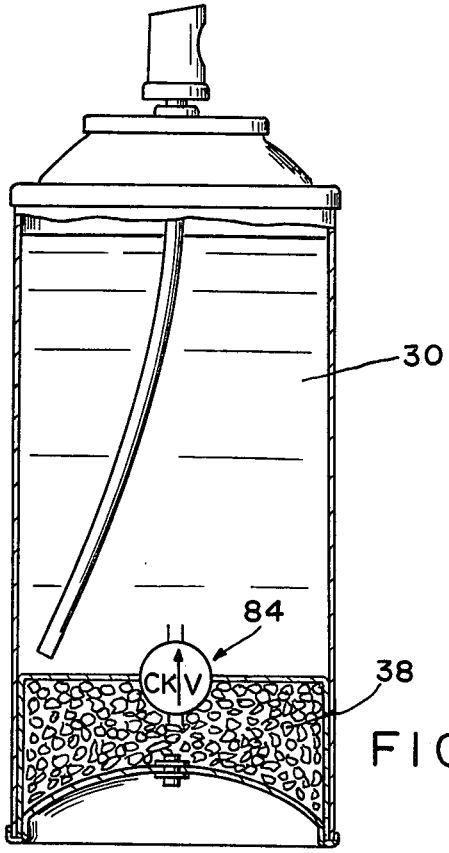

In FIGS. 7 and 9–11, the enclosure defining pressure source chamber 38 includes an inner container body end 74 and an outer body 40 to which charging valve 42 is secured. Such enclosure is effectively secured to the container body adjacent the product chamber. Secured to inner end 74 in FIGS. 7, 10 and 11 are three different means for transmitting gas from pressure source chamber 38 to product chamber 30.

In FIG. 7, the transmission means includes a membrane patch 76 which is affixed to inner end 74 over an orifice 78 defined in inner end 74. Membrane patch 76 is made of a material allowing passage of gas therethrough in either direction but resisting passage of a non-gaseous fluid such as the product to be dispensed. Suitable membrane materials may be chosen, by those skilled in the art and familiar with the invention, to suit the products with which they will be used. For aqueous-based products, membrane patch 76 is preferably a continuous mat of polytetrafluoroethylene microfibers in a criss-cross pattern fused together at each intersection and bonded to a polyethylene net. A membrane material from Millipore Corporation of Bedford, Massachusetts, sold under the trademark FLUOROPORE, has been found to function very well with a number of aqueous-based products; such products will not pass therethrough at normal packaging pressures, but propellent gas will readily pass therethrough in both directions. In the embodiment illustrated in FIG. 9, membrane material 80 of the type used in membrane patch 76 forms a substantial part of the enclosure defining source chamber 38. Membrane material 80 spans the container body and is attached thereto at lower edge 58 of container 20.

In the embodiment of FIG. 10, the means to transmit gas from pressure source chamber 38 to product chamber 30 is a constant pressure valve 82 secured to inner end 74. Constant pressure valve 82 allows passage of gas from source chamber 38 to product chamber 30 to maintain pressure in product chamber 30 at a substantially constant level no higher, and usually much lower, than the pressure in source chamber 38. In the embodiment of FIG. 11, a check valve 84 secured to inner end 74 comprises the means to transmit gas from pressure source chamber 38 to product chamber 30. Check valve 84 responds to a drop in the pressure in product chamber 30 by permitting flow of gas from source chamber 38 to product chamber 30 to equalize the pressures in pressure source chamber 38 and product chamber 30.

The filling and pressurizing methods usable for the devices of FIGS. 7 and 9–11 are the methods previously described. However, in the devices of FIGS. 7 and 9, it may also be possible to charge propellent gas into pressure source chamber 38 through product chamber 30 rather than directly through charging valve 42. In such cases, propellent gas could be charged through valve means 24 or around valve cup 46, either before, after or during the filling of fluid product. Propellent gas would pass into source chamber 38 from product chamber 30 either directly or through temporary solution in or commingling with the fluid product.

Figure 12:
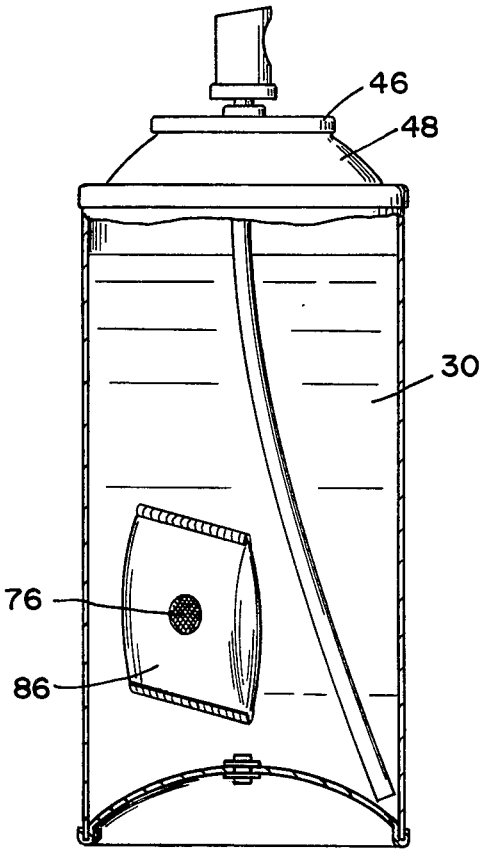
Figure 13:
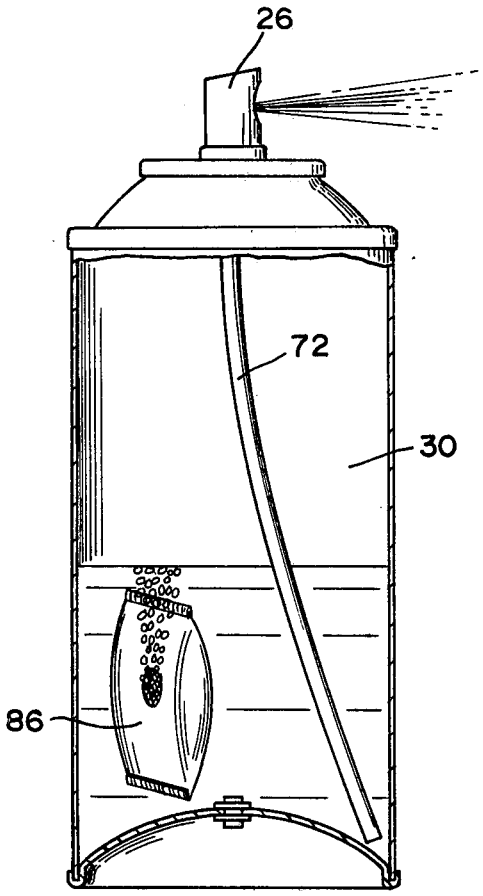
Figure 14:
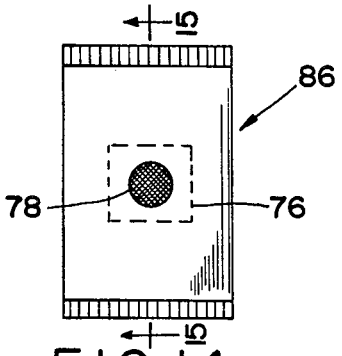
FIG. 14 is a front elevation of a portion of the device shown in FIGS. 12 and 13.
Figure 15:
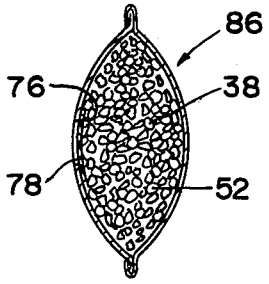
FIG. 15 is a side sectional view along section 15—15 as indicated in FIG. 14.

In the embodiment illustrated in FIGS. 12 and 13, pressure source chamber 38 is defined by an unsupported enclosure 86 free within product chamber 30. Enclosure 86 is a packet or pouch which may be made, for example, of plastic coated foil. The packet or pouch 86 encloses numerous pellets 52 of activated charcoal. Enclosure 86 defines an orifice 78 which is covered by a membrane 76 made of a material allowing passage of gas but resisting passage of non-gaseous fluid, as previously described. Membrane patch 76 is secured to the pouch-forming material on the inside surface thereof about orifice 78 as illustrated in FIGS. 14 and 15.

The container-dispenser shown in FIGS. 12 and 13 is filled and pressurized by the following method. First, the gas-adsorbent solid 52 is loaded into the pressure source chamber 38 while remote from the product chamber, as chamber 38 is formed. Thereafter, the packet, filled with pellets 52, is placed into a low temperature environment having a high concentration of the adsorbable gas. If the adsorbable gas is carbon dioxide, the packet may be placed in a low temperature compartment having dry ice and carbon dioxide gas therein. Over a period of time in such a compartment, a large amount of carbon dioxide gas will be adsorbed onto the surfaces of pellets 52. This procedure is carried out when the source chamber is remote from the product chamber.

After the propellent gas has been loaded into pressure source chamber 38, the packet is dropped into product chamber 30, either before or after filling of product chamber 30 with the fluid product to be dispensed. Product chamber 30 is then sealed, such as by seaming of valve cup 46 to dome 48. As the temperature of the materials within pressure source chamber 38 rises to room temperature, propellent gas is released from adsorption on pellets 52 and bubbles through membrane patch 76 to provide headspace pressure.

When dispensing button 26 is depressed, as illustrated in FIG. 13, the headspace pressure drives the fluid product in chamber 30 through dip tube 72 and out of the container. As this occurs and for a short period after dispensing is stopped, the gas adsorbed on pellets 52 is gradually released and exits pressure source chamber 38 to reinforce the headspace pressure in product chamber 30. Packet 86 may be in any position within product chamber 30, either submerged within the fluid product or in the headspace. Its location will have little or no effect on its operation in reinforcing headspace pressure.

While in some cases it may be desirable to completely charge the pressure source chamber of FIGS. 12 and 13 in a position remote from product chamber 30, the gas charging could be carried out after enclosure 86 is inserted into product chamber 30 and either before or after charging of fluid product. Such charging is substantially as described as an alternative propellent charging method for the devices shown in FIGS. 7 and 9.

Figure 16:
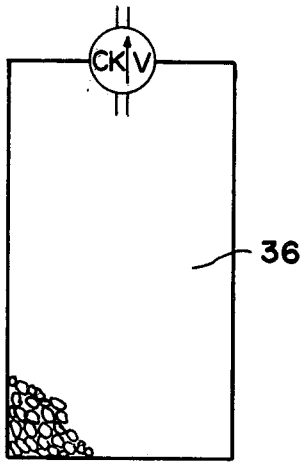
FIGS. 16 and 17 are schematics of alternatives for the device shown in FIGS. 14 and 15.
Figure 17:
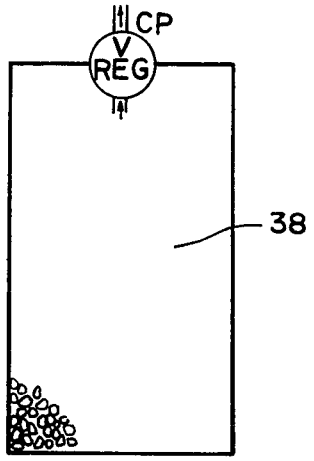

FIGS. 16 and 17 schematically illustrate the use of other pressure transmission means with a free enclosure which defines pressure source chamber 38. FIG. 16 is representative of a small enclosure including a check valve which would operate in substantially the same manner as the check valve shown in FIG. 11. FIG. 17 is representative of a small enclosure including a constant pressure valve which would operate in substantially the same manner as the constant pressure valve shown in FIG. 10. A constant pressure valve or check valve may readily be attached to a slender cylindrical metal container which would be free within product chamber 30.

The unsupported enclosure free within the product chamber may be in a variety of forms other than the packets illustrated and the slender cylindrical metal enclosure just mentioned. For example, metal or plastic containers of various shapes, having a membrane of the type described or, in the alternative, a check valve, constant pressure valve or other suitable gas transmission means secured thereto, may be used. Another form for the unsupported enclosure may be a packet generally as shown in FIGS. 12–15 but formed in substantial part by a membrane material of the type allowing passage of gas but resisting passage of non-gaseous fluid product. In such cases, it may be desirable to provide some reinforcement for such a packet; this may be accomplished by a screen backing for the membrane material. A wide variety of forms and materials may be used to make unsupported enclosures according to this invention, and such will be known to those skilled in the art who are made aware of this invention.

In each of the embodiments of the device of the container-dispenser of this invention, a gas reserve is provided by the adsorption of gas on a gas-adsorbent solid. Pressure in the source chamber is substantially reinforced by such adsorbed gas despite a decrease in gas/volume in the source chamber as the product is dispensed. In the embodiments illustrated in FIGS. 2–6, as product is dispensed a decrease in gas/volume in the pressure source chamber is caused by an increase in the volume of the pressure source chamber despite a constant amount of gas therein. In the embodiments illustrated in FIGS. 7–17, as product is dispensed a decrease in gas/volume in the source chamber is caused by passage of gas from the pressure source chamber to the product chamber, the volume of the source chamber remaining substantially constant. An embodiment may be made in which both the volume of the pressure source chamber and the amount of gas therein change during dispensing of product. In such an embodiment, some gas would pass from the pressure source chamber into the product chamber and the pressure source chamber would exert physical pressure on the product chamber as well.

Figure 18:
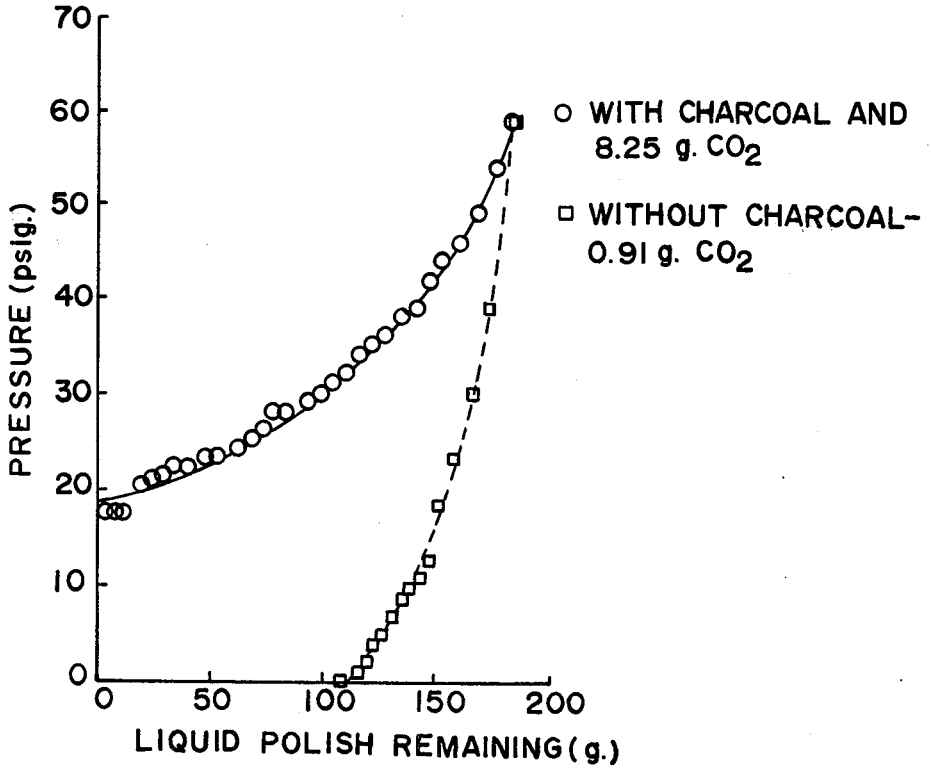
FIG. 18 is a exemplary pressure graph comparing the drop in pressure occurring during dispensing of the contents of a container-dispenser according to this invention to the drop occurring in a similar product using a non-condensible gas as propellent but not incorporating this invention.

The pressure graph of FIG. 18 is an example of certain advantages of this invention. The data forming this graph was derived from a piston-type container-dispenser of the type shown in FIG. 6. Activated charcoal and carbon dioxide were used in one case, representing the invention; in the case for comparison, carbon dioxide was used without any gas-adsorbent solid. The dispensing pressure was inadequate for proper dispensing without the invention but substantially reinforced and sufficient for proper dispensing when the invention was used.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

We claim:

1. In a pressurized container-dispenser of the type having a container body and a product chamber therein, valve means for controlling the dispensing of a product therefrom and means to pressurize the product chamber whereby to expel product through the valve means, the improvement wherein said pressurizing means comprises:

a separate pressure source chamber within said container body;

a gas-adsorbent solid and a gas adsorbable thereon within said source chamber to provide a gas reserve whereby pressure in said source chamber is substantially reinforced despite a decrease in gas/volume in the source chamber; and means to transmit pressure of the source chamber to the product chamber.

2. The device of claim 1 wherein said gas-adsorbent solid is activated charcoal.

3. The device of claim 2 wherein said gas is selected from the group consisting of carbon dioxide and nitrous oxide.

4. The device of claim 1 wherein said transmission means comprises a moveable wall separating said product chamber and said source chamber, said wall being free to move in response to pressure in said source chamber upon a drop in pressure in said product chamber.

5. The device of claim 4 wherein said product chamber comprises a collapsible bag, said bag forming said moveable wall.

6. The device of claim 4 wherein said source chamber comprises an expandable bag, said bag forming said moveable wall.

7. The device of claim 4 wherein said moveable wall is a piston in sealed, slidable engagement with said container body.

8. The device of claim 1 wherein said transmission means comprises a membrane of the type allowing passage of gas but resisting passage of non-gaseous fluid.

9. The device of claim 8 wherein said membrane comprises a continuous mat of polytetrafluoroethylene microfibers fused together at their intersections, and said product is aqueous based.

10. The device of claim 8 wherein said source chamber is defined by an enclosure formed in substantial part by said membrane.

11. The device of claim 10 wherein said membrane comprises a continuous mat of polytetrafluoroethylene microfibers fused together at their intersection, and said product is aqueous based.

12. The device of claim 1 wherein said transmission means comprises a constant pressure valve allowing passage of gas from said source chamber to said product chamber to maintain pressure in said product chamber at a substantially constant level no higher than the pressure in said source chamber.

13. The device of claim 1 wherein said transmission means is a check valve permitting flow of said gas from said source chamber to said product chamber in response to a drop in pressure in the product chamber.

14. The device of claim 1 wherein said source chamber is defined by an enclosure of fixed volume secured to said container body adjacent to said product chamber, said transmission means being secured to said enclosure.

15. The device of claim 14 wherein said transmission means is a check valve permitting flow of said gas from said source chamber to said product chamber in response to a drop in pressure in the product chamber.

16. The device of claim 14 wherein said transmission means comprises a membrane of the type allowing passage of gas but resisting passage of non-gaseous fluid.

17. The device of claim 16 wherein said enclosure is formed in substantial part by said membrane.

18. The device of claim 14 wherein said transmission means is a constant pressure valve allowing passage of gas from said source chamber to said product chamber to maintain pressure in said product chamber at a substantially constant level no higher than the pressure in said source chamber.

19. The device of claim 14 wherein said enclosure has means for charging gas into said source chamber through said container body.

20. The device of claim 14 wherein said enclosure comprises inner and outer body ends at one end of said container body, said transmission means being secured to said inner end.

21. The device of claim 20 wherein said transmission means comprises a membrane of the type allowing passage of gas but resisting passage of non-gaseous fluid.

22. The device of claim 21 wherein said inner end is formed in substantial part by said membrane.

23. The device of claim 20 wherein said transmission means is a constant pressure valve allowing passage of gas from said source chamber to said product chamber to maintain pressure in said product chamber at a substantially constant level no higher than the pressure in said source chamber.

24. The device of claim 20 wherein said transmission means is a check valve permitting flow of said gas from said source chamber to said product chamber in response to a drop in pressure in the product chamber.

25. The device of claim 1 wherein said pressure source chamber is defined by an unsupported enclosure free within said product chamber.

26. The device of claim 25 wherein said enclosure has a substantially fixed volume and has said transmission means secured thereto.

27. The device of claim 26 wherein said transmission means is a check valve permitting flow of said gas from said source chamber to said product chamber in response to a drop in pressure in the product chamber.

28. The device of claim 26 wherein said transmission means comprises a constant pressure valve allowing passage of gas from said source chamber to said product chamber to maintain pressure in said product chamber at a substantially constant level no higher than the pressure in said source chamber.

29. The device of claim 26 wherein said transmission means comprises a membrane of the type allowing passage of gas but resisting passage of non-gaseous fluid.

30. The device of claim 25 wherein said gas-adsorbent solid is activated charcoal.

31. The device of claim 30 wherein said gas is selected from the group consisting of carbon dioxide and nitrous oxide.

32. The device of claim 25 wherein said gas is a non-condensible gas.

33. The device of claim 32 wherein said gas is selected from the group consisting of nitrogen, nitrous oxide, carbon dioxide, helium, argon, neon, krypton, xenon and mixtures thereof.

34. The device of claim 33 wherein said gas is selected from the group consisting of carbon dioxide and nitrous oxide.

35. The device of claim 1 wherein said gas is a non-condensible gas.

36. The device of claim 35 wherein said gas is selected from the group consisting of nitrogen, nitrous oxide, carbon dioxide, helium, argon, neon, krypton, xenon and mixtures thereof.

37. The device of claim 36 wherein said gas is selected from the group consisting of carbon dioxide and nitrous oxide.

* * * * *